US006398326B1

(12) United States Patent
Wang

(10) Patent No.: US 6,398,326 B1
(45) Date of Patent: Jun. 4, 2002

(54) COMPUTER DESK

(76) Inventor: Chih-Hsing Wang, P.O. Box 90, Tainan City (TW)

( * ) Notice: Subject to any disclaimer, the term of this patent is extended or adjusted under 35 U.S.C. 154(b) by 0 days.

(21) Appl. No.: 09/986,497

(22) Filed: Nov. 9, 2001

(51) Int. Cl.[7] ..... A47B 47/00
(52) U.S. Cl. ..... 312/223.3; 108/50.01
(58) Field of Search ..... 312/194, 195, 312/196, 208.1, 223.3, 280, 281; 108/11, 13, 50.01, 59, 92, 93, 96, 101, 144.11, 157.13, 158

(56) References Cited

U.S. PATENT DOCUMENTS 4,146,269 A * 3/1979 Beckley ..... 108/158 X
4,640,199 A * 2/1987 Zigman ..... 312/223.3 X
4,646,655 A * 3/1987 Robolin ..... 108/92
5,044,284 A * 9/1991 Gross ..... 312/223.3 X
5,419,525 A * 5/1995 Hilton ..... 108/50.01 X
5,623,881 A * 4/1997 Hung ..... 108/50.01
5,704,298 A * 1/1998 Corpuz, Jr. et al. ..... 108/50.01
5,845,586 A * 12/1998 Moore ..... 108/50.01
5,967,631 A * 10/1999 Ko ..... 312/194
6,220,180 B1 * 4/2001 Janowitz ..... 108/101 X

* cited by examiner

*Primary Examiner*—James O. Hansen

(57) ABSTRACT

A computer desk has two pairs of opposite stand-frames and several supporting-plates. Each pair of stand-frames having a plurality of bigger through-holes and smaller through-holes in their outer walls by characterized a smaller through-hole in an inner wall opposite to the bigger through-hole in the outer wall and a bigger through-hole in an inner wall opposite to the smaller through-hole in the outer wall. Every supporting-plate has several connecting-rods at its bottom surface. Every connecting-rod has an internal-threaded hole in its outer end. After the outer end of the connecting-rod is inserted into one of the bigger through-holes, a screw-member can be extended through the smaller through-hole opposite to the bigger through-hole and screwed with the internal-threaded hole of the connecting-rod so that the supporting-plate can be assembled or changed to any required location on the pair of stand-frames by a user quickly and conveniently.

2 Claims, 4 Drawing Sheets

COMPUTER DESK

BACKGROUND OF THE INVENTION

1. Field of the Invention

This invention relates to a computer desk, particularly to one having two pairs of opposite stand-frames correspondingly arranged with a plurality of bigger through-holes and smaller through-holes capable of allowing a user to assemble supporting-plates to any required locations of the stand-frames with convenience and fastness.

2. Description of the Prior Art

Generally speaking, a known conventional computer desk mainly has a desk-plate, a monitor supporting-plate, a keyboard supporting-plate and a main-machine frame. Moreover, there are supporting-plates assembled at two outer sides of the desk-plate for being placed with books or other computer appliances. However, the supporting-plates are assembled in a stationary way so that a user cannot assemble them to any required locations of the computer desk, which makes the supporting-plates unable to achieve an optimum using effect.

SUMMARY OF THE INVENTION

The main purpose of the invention is to offer a computer desk allowing a user to assemble and change supporting-plates to any required locations of stand-frames with convenience and fastness.

The main feature of the invention is to provide a computer desk having two pairs of opposite stand-frames and several supporting-plates, wherein each pair of opposite stand-frames are arranged with a plurality of bigger through-holes and smaller through-holes in outer walls of the pair of opposite stand-frames in a way of having a smaller through-hole correspondingly disposed in an inner wall opposite to the bigger through-hole in the outer wall of the pair of opposite stand-frames and having a bigger through-hole correspondingly disposed in an inner wall opposite to the smaller through-hole in the outer wall of the pair of opposite stand-frames; each of the supporting-plate has several connecting-rods disposed at its bottom surface, and each of the connecting-rods has an internal-threaded hole formed in its outer end, by which after the outer end of the connecting-rod is inserted into one of the bigger through-holes of the pair of opposite stand-frames, a screw-member is capable of being extended through the. smaller through-hole correspondingly disposed in the inner wall opposite to the bigger through-hole of the pair of opposite stand-frames and firmly screwed with the internal-threaded hole of the connecting-rod so that the supporting-plate can be fixedly assembled to the pair of opposite stand-frames.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
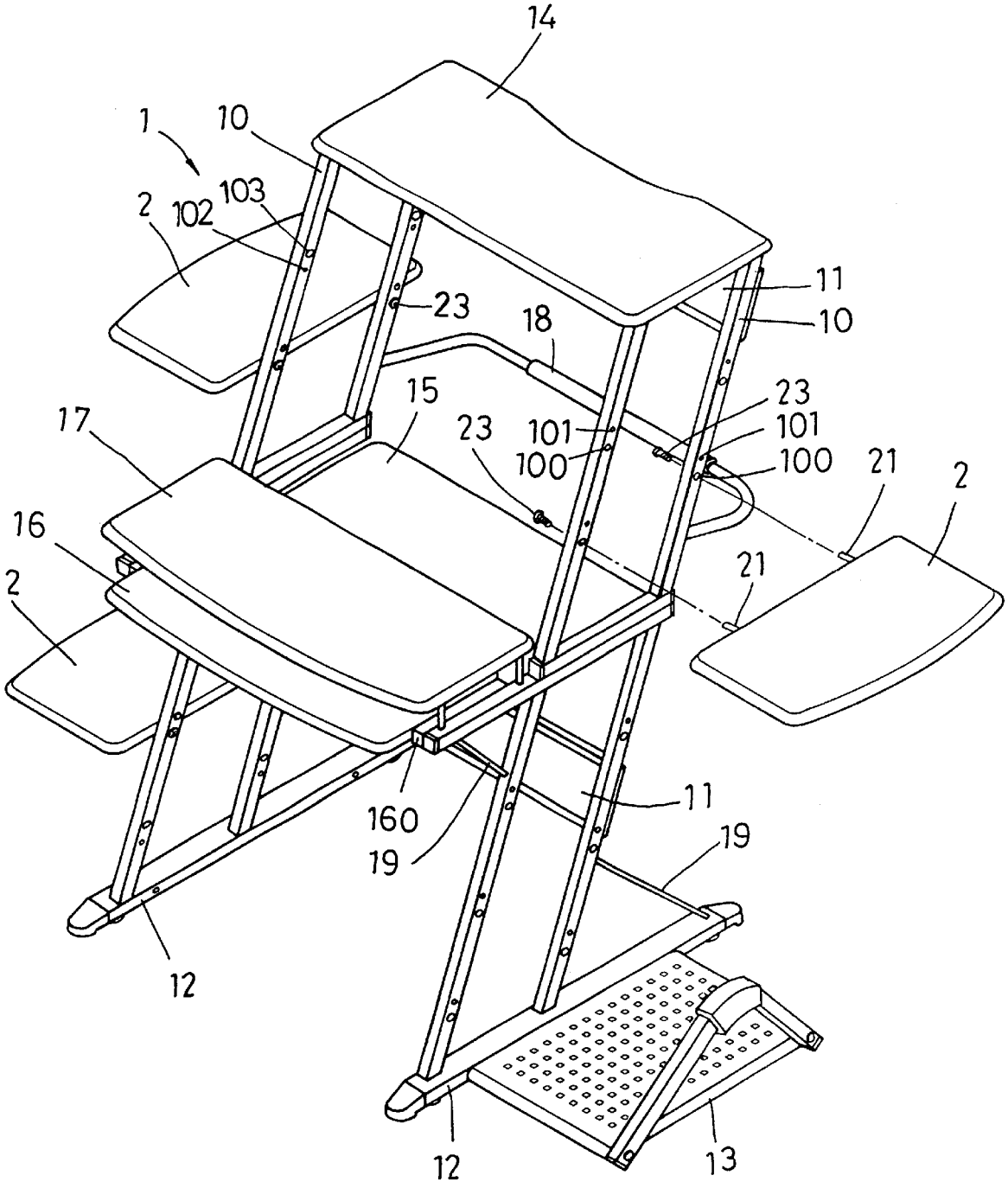
FIG. 1 is a partial exploded perspective view of a: computer desk in the present invention.

A first preferred embodiment of a computer desk in the present invention, as shown in FIG. 1, has a computer desk

1 mainly consisting of two pairs of opposite and parallel-sloping stand-frames 10 and several supporting-plates 2.

Each pair of opposite and parallel-sloping stand-frames 10 defined as a front stand-frame and a rear frame are correspondingly arranged with a plurality of bigger through-holes 100 and smaller through-holes 101 on outer walls of the two opposite stand-frames 10 in a way of having a smaller through-hole 102 correspondingly disposed in an inner wall opposite to each of the bigger through-holes 100 of the outer walls of the two opposite stand-frames 10 and having a bigger through-hole 103 correspondingly disposed in an inner wall opposite to each of the smaller through-holes 101 of the outer walls of the two opposite stand-frames 10. Several linking-plates 11 disposed between the rear stand-frames of the two pairs of opposite stand-frames 10. Two foot-frames 12 respectively combined at bottoms of each pair of opposite stand-frames 10 and one of the two foot-frames 12 has a main-machine frame 13 disposed at its outer side. A top-plate 14 is disposed at both tops of the two pairs of opposite stand-frames 10. A monitor supporting-plate 15 is disposed between the two pairs of opposite stand-frames 10. A keyboard supporting-plate 16 disposed in front of the monitor supporting-plate 15 has two slide-rails 160 at both sides for being respectively fixed to the two pairs of opposite stand-frames 10. A desk-plate 17 is disposed over the keyboard supporting-plate 16. A guard-rod 18 is disposed behind the monitor supporting-plate 15 and has both ends firmly fixed to the rear stand-frames of the two pairs of opposite stand-frames 10. There are four auxiliary brackets 19 respectively disposed between bottoms of the two slide-rails 160 of the keyboard supporting-plate 16 and the front stand-frames of the two pairs of opposite stand-frames 10 and between the rear stand-frames of the two pairs of opposite stand-frames 10 and the two foot stand-frames 12.

Figure 2:
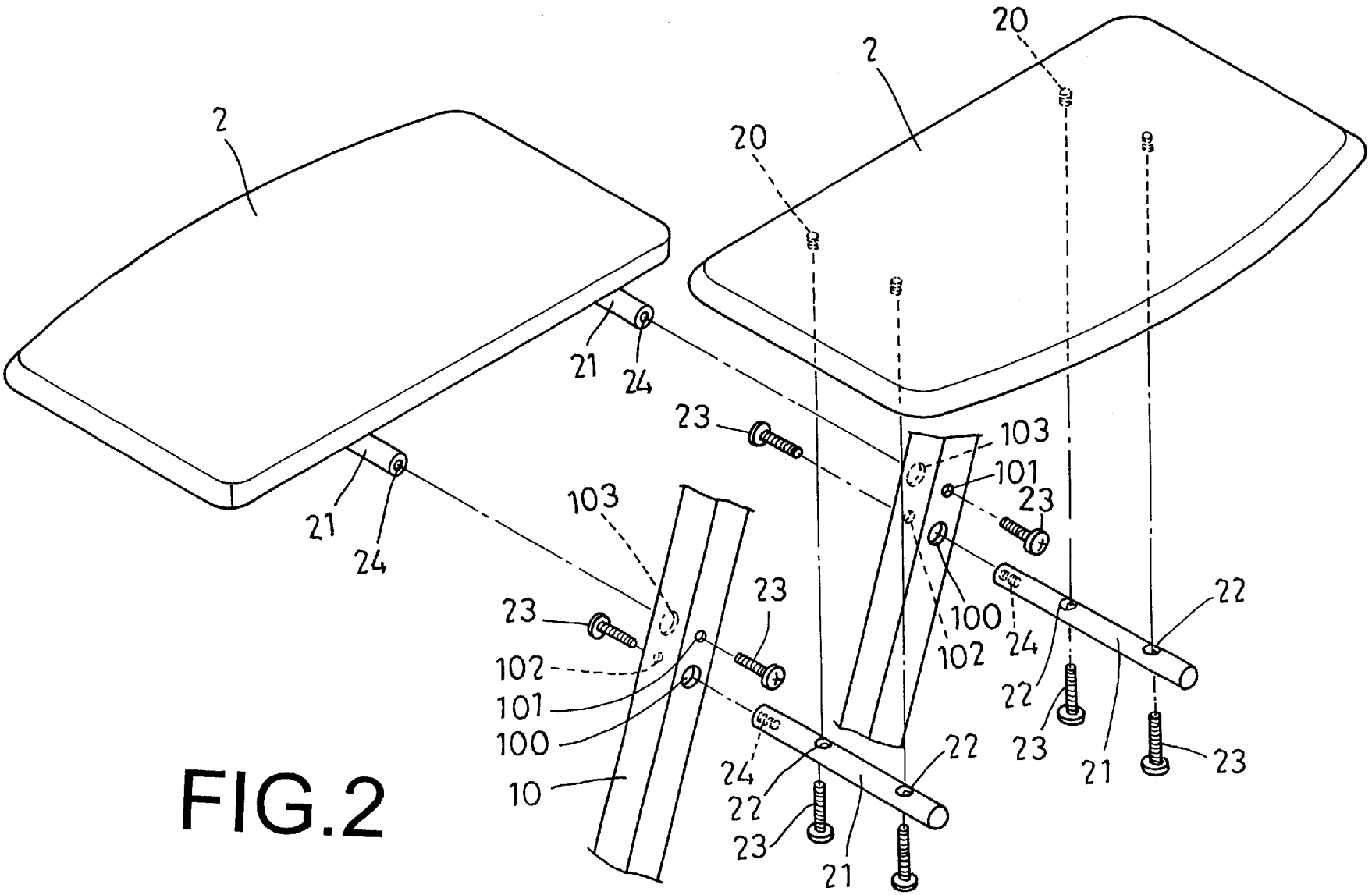
FIG. 2 is an exploded perspective view of supporting-plates of the computer desk in the present invention.

Each of the several supporting-plates 2, as shown in FIG. 2, has a. plurality of screw-holes 20 arranged at a bottom surface of the supporting-plate 2. Two connecting-rods 21 are oppositely disposed below the supporting-plate 2 and each of the two connecting-rods 21 has a plurality of through-holes 22. A plurality of screw-members 23. are capable of being extended through the plurality of through-holes 22 of the two connecting-rods 21 and screwed with the plurality of opposite screw-holes 20 of the supporting-plate 2 so as to make the two opposite connecting-rods 21 firmly screwed at the bottom surface of the supporting-plate 2 with an outer end of said connecting-rod protruded outwardly at one side of supporting-plate 2. An internal-threaded hole 24 is formed in the outer end of each of the two opposite connecting-rods 21 for being extended through by a screw-member 23 so as to make connecting-rods 21 fixedly screwed with each of the two pairs of opposite stand-frames 10.

Figure 3:
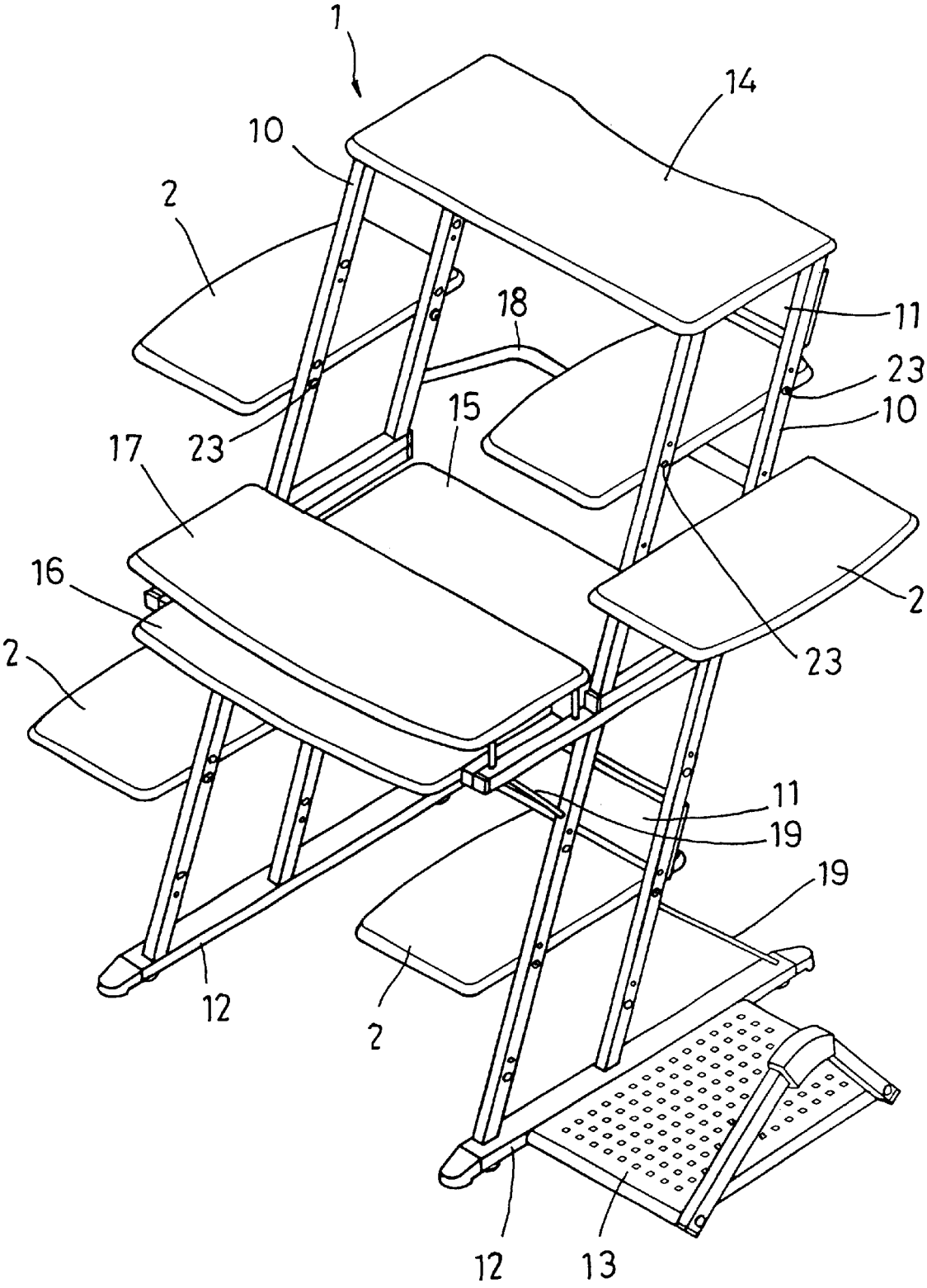
FIG. 3 is a perspective view of showing an assemblage of the computer desk in the present invention; and, FIG. 4 is a cross-sectional view of showing an assemblage of the supporting-plates and a pair of opposite stand-frame of the computer desk in the present invention.
Figure 4:
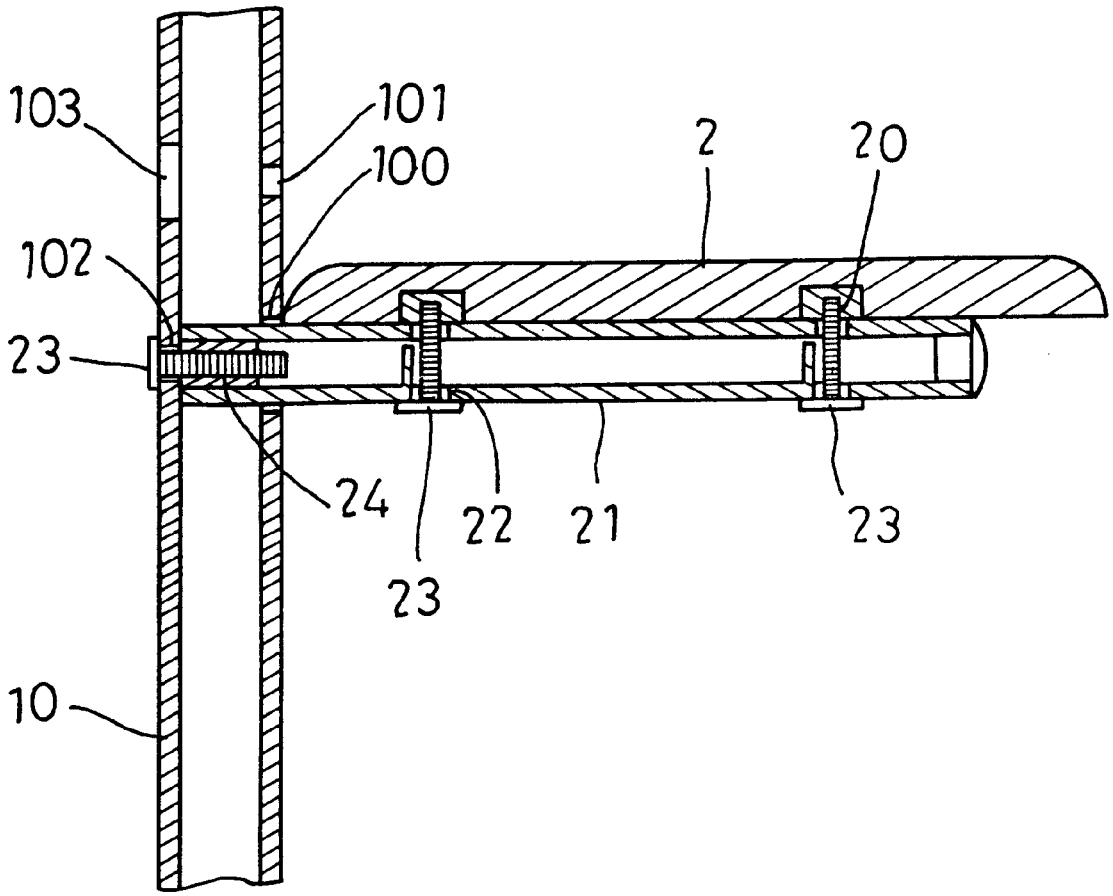

In assembling, referring to FIGS. 2, 3 and 4, firstly a user himself makes the plurality of through-holes 22 of the two connecting-rods 21 respectively aligned with the plurality of opposite screw-holes 20 of one of the several supporting-plates 2 and has a plurality of screw-members 23 respectively extended through the plurality of through-holes 22 and screwed in the plurality of opposite screw-holes 20 of the supporting-plate 2 so that the two connecting-rods 21 can be firmly screwed at the bottom of the supporting-plate 2. Secondly, the user assembles the supporting-plate 2 to any required locations of one pair of stand-frames 10 according to his need. In the case that the supporting-plate 2 is to be assembled on the outer walls of one pair of stand-frames 10, firstly the user inserts the outer ends of the two connecting-rods 21 of the supporting-plate 2 into one of the bigger through-holes 100 disposed in outer walls of the pair of stand-frames 10 and makes the internal-threaded holes 24 of the outer ends of the two connecting-rods 21 respectively aligned with the smaller through-holes 102 disposed in the inner walls of the pair of stand-frames 10. And then, extend two screw-members 23 respectively through the smaller through-holes 102 of the pair of stand-frames 10 to be screwed in the internal-threaded holes 24 of the outer ends of the two connecting-rods 21 so as to have the supporting-plate 2 firmly fixed on the outer walls of the pair of stand-frames 10. On the contrary, In the case that the supporting-plate 2 is to be assembled on the inner walls of one pair of stand-frames 10, firstly the user inserts the outer ends of the two connecting-rods 21 of the supporting-plate 2 into one of the bigger through-holes 103 disposed in inner walls of the pair of stand-frames 10 and makes the internal-threaded holes 24 of the outer ends of the two connecting-rods 21 respectively aligned with the smaller through-holes 101 disposed in the outer walls of the pair of stand-frames 10. And then, extend two screw-members 23 respectively through the smaller through-holes 101 of the pair of stand-frames 10 to be screwed in the internal-threaded holes 24 of the outer ends of the two connecting-rods 21 so as to have the supporting-plate 2 firmly fixed on the inner walls of the pair of stand-frames 10. In such ways, the user himself can adjust the assembling locations of the supporting-plate 2. with convenience and fastness according to his need.

While the preferred embodiment of the invention has been described above, it will be recognized and understood that various modifications may be made therein and the appended claims are intended to cover all such modifications that may fall within the spirit and scope of the invention.

What is claimed is:

1. A computer desk comprising:

a pair of opposite and parallel-sloping stand-frames, each of the stand-frames including a front stand-frame member and a rear stand-frames member; several linking-plates disposed between the rear stand-frames members; two foot-frames being connected at bottoms of the stand-frames and one of the two foot-frames having a main-machine frame disposed on an outer side; a top-plate disposed at tops of the stand-frames; a monitor supporting-plate disposed between the stand-frames; a keyboard supporting-plate disposed in front of the monitor supporting-plate and having two sliding rails at both sides for fixing to the stand-frames; a desk-plate disposed over the keyboard supporting-plate; a guard-rod disposed behind the monitor supporting-plate and having both ends firmly fixed to the rear stand-frame members; auxiliary brackets respectively disposed between bottoms of the slide-rails and the front stand-frame members, and between the two foot-frames; and several supporting-plate capable of being assembled to the stand-frames;

the computer desk characterized by each stand-frames including inner and outer walls with each wall having a plurality of bigger through-holes and smaller through-holes, smaller through-holes correspondingly disposed in the inner walls opposite to bigger through-holes disposed in the outer walls, and bigger through-holes correspondingly disposed in the inner walls opposite to small through-holes disposed in the outer walls; each of the supporting-plate having several connecting-rods disposed at a bottom surface of the supporting plate, each of the connecting-rods having an internal-threaded hole framed in an outer end, whereby the outer end of each connecting-rod is inserted into a respective one of the bigger through-holes; a plurality of screw members capable of being extended through the smaller through-holes correspondingly disposed in the inner walls opposite to the big through-holes are firmly screwed to the internal-threaded holes of the connecting-rods so that the supporting plates can be fixedly assembled to the stand-frames, the supporting-plates being movable to any required location on the stand-frames by a user quickly and conveniently.

2. The computer desk as claimed in claim 1, wherein each of the supporting-plates have a plurality of screw-holes arranged in a bottom surface, and each of the connecting-rods have a plurality of through-holes, whereby the plurality of screw-members are capable of extending through the through-holes of the connecting-rods and screwed into the screw-holes of the supporting-plates so that the supporting-plates can be firmly attached to the connecting-rods.

* * * * *